United States Patent [19]

LaPoint

[11] Patent Number: 4,795,386

[45] Date of Patent: Jan. 3, 1989

[54] ASSYMETRICAL WATER SKI

[75] Inventor: Kris LaPoint, Fair Oaks, Calif.

[73] Assignee: The Coleman Company, Inc., Wichita, Kans.

[21] Appl. No.: 59,918

[22] Filed: Jun. 9, 1987

[51] Int. Cl.[4] ..... A63C 5/00

[52] U.S. Cl. ..... 441/68; 280/608; 280/609

[58] Field of Search ..... 441/65, 68, 70–75, 441/79; 180/180, 182; 280/601, 602, 607–609

[56] References Cited

U.S. PATENT DOCUMENTS

| | | | |
|---|---|---|---|
| 3,501,160 | 3/1970 | Lange | 280/609 |
| 3,944,239 | 3/1976 | Hastings | 280/608 |
| 4,305,603 | 12/1981 | Muller | 280/609 |
| 4,314,384 | 2/1982 | Weinhaus | 441/68 |
| 4,585,249 | 4/1986 | Plenk | 280/609 |
| 4,608,023 | 8/1986 | Williams | 441/68 |

FOREIGN PATENT DOCUMENTS 262116 5/1968 Fed. Rep. of Germany .

*Primary Examiner*—Joseph F. Peters, Jr.
*Assistant Examiner*—Clifford T. Bartz

[57] ABSTRACT

A slalom water ski comprises an elongated ski body and front and rear foot bindings mounted on the ski body. The ski body includes a pair of assymetrical sides which provide the ski with a strong side and a weak side. The strong side has a relatively sharp pivot point in the area of the foot bindings and extends inwardly toward the longitudinal centerline of the ski and the front and rear portions of the ski. The weak side curves smoothly from the forward end to the tail end and extends generally parallel to the longitudinal centerline of the ski adjacent the front foot binding. A beveled portion extends between each of the sides and the bottom surface, and the angle between the beveled portion and the bottom is greater on the strong side than on the weak side.

13 Claims, 2 Drawing Sheets

FIG. 1
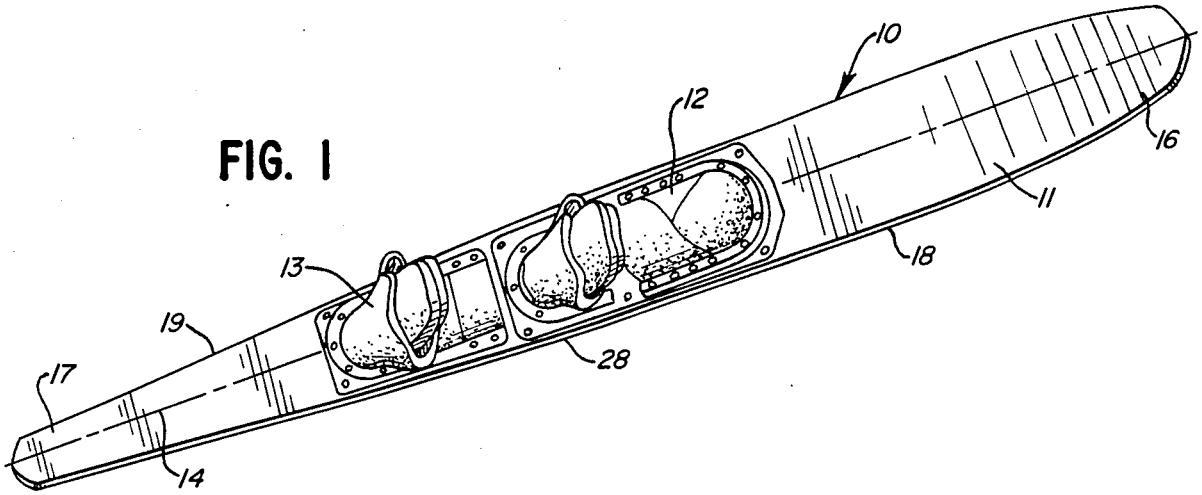
FIG. 4
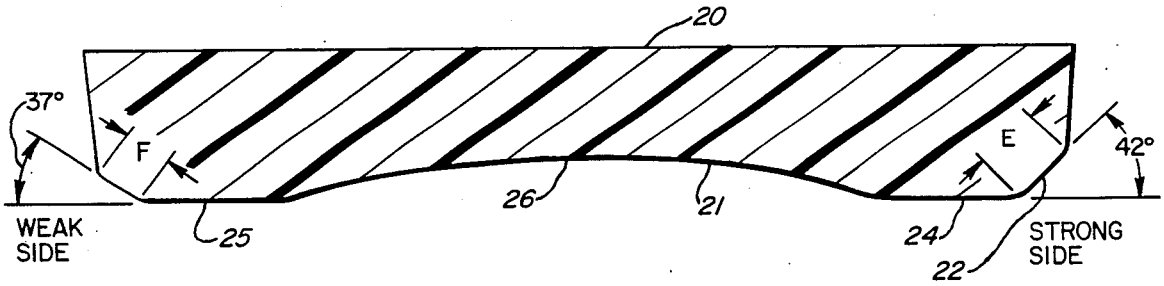
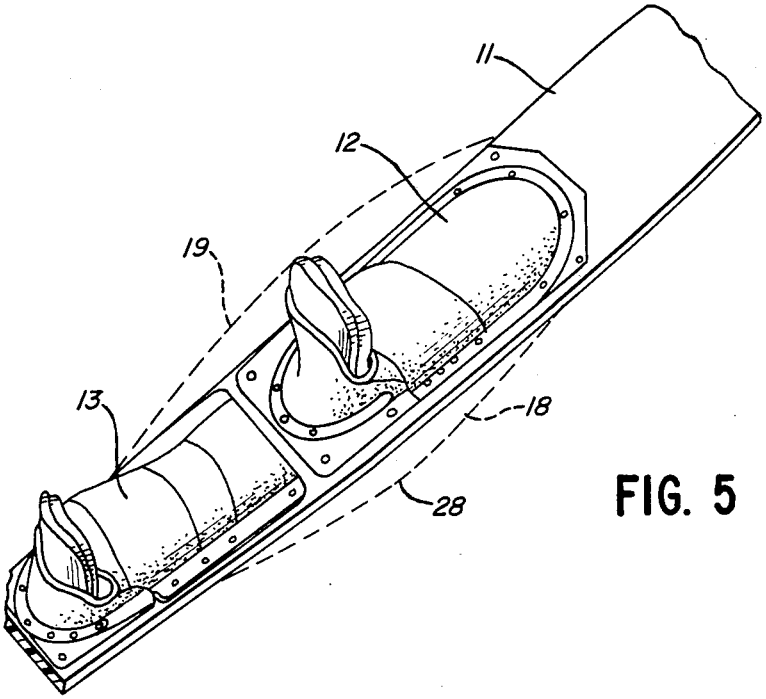
FIG. 5

ASSYMETRICAL WATER SKI

BACKGROUND

This invention relates to water skis, and, more particularly, to a slalom water ski which has assymetrical sides to provide the ski with a strong side and a weak side.

A slalom water ski includes a pair of foot bindings which are located along the longitudinal centerline of the ski. The skier has one foot in the front binding and one foot in the rear binding. Some skiers prefer to ski with their right foot in the front binding, and others prefer to ski with their left foot in the front binding.

Because the position of the feet are fixed, all slalom skiers have trouble turning in one direction. A skier with his right foot forward has trouble turning to the left. A skier with his left foot forward has trouble turning to the right. This is because the position of the body is different during right and left turns. For a skier who skis with his right foot forward, right turns are called strong side or on side turns, and left turns are called weak side or off side turns. Conversely, for a left-foot-forward skier, the left side is his strong side and the right side is his weak side.

During a weak side turn, the skier's body is more "closed" to the boat and his weight is farther forward. When the skier reaches during a weak side turn, more weight gets transferred to his front foot. This in turn puts more of the ski in the water which is what is needed on the weak side to get maximum deceleration. During a strong side turn, the skier's body is more "open" to the boat, and therefore more weight is on the rear foot.

Heretofore, slalom ski designs were compromises because one design was used by both right-foot-forward skiers and by left-foot-forward skiers.

SUMMARY OF THE INVENTION

The invention provides an assymetrical slalom water ski which is specifically designed to provide a strong side and a weak side. The weak side curves smoothly from the front end to the tail end and extends generally parallel to the longitudinal centerline of the ski adjacent the front foot binding. This permits the ski to be less agressive and to make a slower, carving weak side turn when more weight is on the front foot. In the forebody of the ski the ski is wider on the weak side so that the ski does not grab or sink when the skier's weight is forward. The strong side has a relatively sharp pivot point in the central portion of the ski and tapers in more of a straight line in the front and rear portions of the ski. The pivot point makes the ski more agressive during strong side turns when more weight is on the back of the ski. The forebody of the ski is relatively narrow on the strong side so that the ski will turn more quickly if the forward portion of the ski enters the water during a strong side turn.

The bevels between the sides and the bottom are also assymetrical. The angle between the strong side bevel and the bottom is greater than the angle between the weak side bevel and the bottom. During a strong side turn, a skier tends to have more lean, i.e., his body is closer to the water. The ski is therefore on more of an angle to the water or rides more on the sides than on the bottom. Increasing the angle of the bevel on the strong side allows the ski to ride at more of an angle in the turn. During a weak side turn, the skier tends to come into the turn a little more erect or upright. The flatter bevel on the weak side accommodates the position of the skier.

DESCRIPTION OF THE DRAWING

The invention will be explained in conjunction with an illustrative embodiment shown in the accompanying drawing, in which—

FIG. 1 is a top plan view of a slalom water ski formed in accordance with the invention;

FIG. 4 is an enlarged sectional view taken along the line 4—4 of FIG. 2; and

FIG. 5 is a fragmentary perspective view of the ski of FIG. 1 showing exaggerated and enlarged side curvatures in phantom.

DESCRIPTION OF SPECIFIC EMBODIMENT

Figure 3:
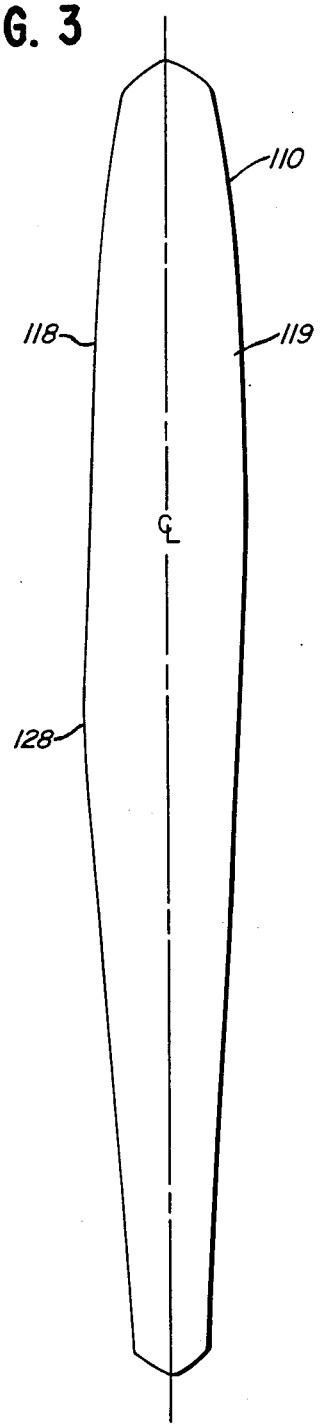
FIG. 3 is a top plan view of a water ski having a strong left side and a weak right side.

Referring first to FIG. 1, a slalom water ski 10 includes an elongated ski body 11 and a pair of foot bindings 12 and 13 which are mounted on the ski body along the longitudinal centerline 14 of the ski body. The bindings are conventional, and any suitable bindings can be utilized.

The ski body includes a forward end 16, a tail end 17, and a pair of sides 18 and 19. Referring to FIG. 4, the ski also includes top and bottom surfaces 20 and 21 and bevels 22 and 23 which extend between the bottom surface 21 and the sides 18 and 19, respectively. The bottom surface has a pair of flat portions 24 and 25 adjacent the bevels and a concave tunnel portion 26. The flat portions 24 and 25 extend generally parallel to the flat top surface 20.

The shape of the ski 10 in FIGS. 1, 2, 4, and 5 is designed to provide a strong right side 18 and a weak left side 19. The ski 10 is intended for a skier who skis with his right foot in the front binding 12 and his left foot in the rear binding 13.

The strong right side 18 includes a relatively sharp pivot point 28 which is located in the center portion of the ski. The front and rear portions 29 and 30 of the strong side taper inwardly toward the centerline 14, and the tapered portions 29 and 30 of the strong side are relatively straight except at the portion adjacent the front end 16.

The pivot point is advantageously located adjacent the heel portion of the front binding 12. In one specific embodiment, the overall length A of the ski was 68 inches, and the pivot point 28 was located a distance B of 33 inches from the tail.

The weak side 19 curves more gradually between the front end and the tail. The forward portion 32 of the weak side 19 curves gradually away from the longitudinal centerline and merges with a portion 33 which extends generally parallel to the centerline 14. The portion 33 merges smoothly with a rear portion 34 which tapers inwardly in a relatively straight line.

Figure 2:
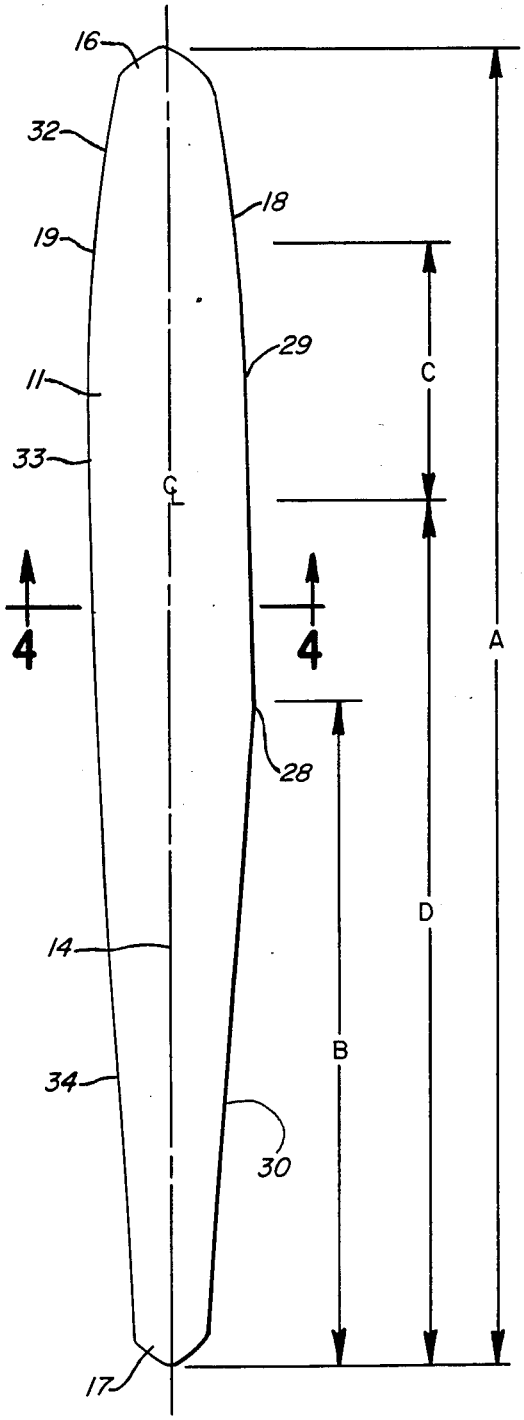
FIG. 2 is a top plan view similar to FIG. 1 of a water ski having a strong right side and a weak left side with the bindings illustrated in phantom.

The forebody of the ski lies generally in the area designated by the dimension C. For the 68 inch ski referred to previously, the forebody portion of the ski was about 13 inches long and extended from about 45 inches from the tail (dimension D) to about 58 inches from the tail. The forebody of the ski in FIG. 2 is wider on the left side or weak side of the centerline 14 than on the right side. This difference in width is only 1/16 to about ⅛ inch, but it is sufficient to provide different performance during strong side and weak side turns as will be explained more fully hereinafter.

Referring again to FIG. 4, the sides 18 and 19 are inclined slightly with respect to the flat top surface 20 and form included angles with the top surface of slightly less than 90°. The angle of the bevel 22 on the strong side relative to the flat portion 24 of the bottom is greater than the angle between the weak side bevel 23 and the bottom portion 25. In one specific embodiment the angle of the strong side bevel 22 was 42°, and the angle of the weak side bevel 23 was about 36° to 37°. The width of each of the beveled portions, i.e., the dimensions E and F, was about ⅜ to about ½ inch.

On the strong side, the junction between the side 18 and the bevel 22 and the junction between the bottom 24 and the bevel are sharper and less rounded than on the weak side. This is particularly true in the area adjacent the rear binding 13 about 19 to 22 inches from the tail. The increased sharpness makes the ski track more and turn more quickly during a strong side turn. The bevel on the weak side is a little smoother and rounder, which causes the ski to track less and to more or less slide in the turns.

During a strong side turn, the skier's body is more open to the boat and more weight is on the rear foot. The shape of the right side of the ski 10 makes the ski more aggressive during right side turns, and the ski turns quickly when there is more weight on the back of the ski than on the front. The forebody of the ski is narrower on the right side which allows for maximum deceleration without having to put too much weight on the front foot. The skier can thereby maintain a good position to make the turn. During a strong side turn, the skier can push the ski around the turn with his back foot. As the ski is pushed through the turn, weight is applied to the tail, and the water breaks on the ski farther back—in the area of the front foot.

During a weak side turn, the skier's body is closed to the boat and more weight is on the front foot. The skier does not have the power of his back foot to push the ski around the turn. Since more weight is forward, the tip of the ski is in the water and initiates the turn. This makes for a more carving type of turn. The shape of the left side of the ski 10 makes the ski less aggressive during left turns, and the ski turns slower and more smoothly. The wider left side of the forebody reduces the possibility that the front of the ski will grab or sink.

The different angles of the bevels 22 and 23 are also designed to facilitate strong side and weak side turns. During a strong side turn, the skier tends to have more lean and the ski is on more of an angle to the water. The increased angle of the strong side bevel 22 permits increased lean of the ski during strong side turns. During a weak side turn, the skier has less lean and tends to stand more upright. The smaller angle of the weak side bevel 23 corresponds to the smaller angle of the ski in the water during the weak side turn.

The ski 110 illustrated in FIG. 3 is the mirror image of the ski 10 of FIG. 2 and is designed to have a strong left side 118 and a weak right side 119. The ski 110 is designed for a left-foot-forward skier who places his left foot in the front binding and his right foot in the rear binding.

The shape of the strong left side 118 of the ski 110 is the same as the shape of the strong right side 18 of the ski 10 and includes a pivot point 128. The shape of the weak right side 119 of the ski 110 is the same as the shape of the weak left side 19 of the ski 10. The transverse cross section of the ski 110 is the mirror image of the cross section illustrated in FIG. 4. The angle between the bevel on the strong left side and the bottom is 42°, and the angle between the bevel on the weak right side and the bottom is about 36° to 37°.

While in the foregoing specification a detailed description of specific embodiments of the invention was set forth for the purpose of illustration, it will be understood that many of the details herein given may be varied considerably by those skilled in the art without departing from the spirit and scope of the invention.

I claim:

1. A slalom water ski comprising an elongated ski body having top and bottom surfaces, a forward end, a tail end, and a pair of sides extending between the forward end and the tail end, front and rear foot bindings mounted on the ski body along a longitudinal line extending from the forward end to the tail end, one of said sides curving smoothly from the forward end to the tail end, said one side extending away from said longitudinal line in the forward portion of the ski body and extending toward said longitudinal line in the rear portion of the ski body, the other side having a pair of relatively straight side portions which meet to provide a point in a middle portion of the ski body and which extend inwardly from said point toward said longitudinal line in the forward and rearward portions of the ski body.

2. The water ski of claim 1 in which said point is located at approximately the midpoint of the ski body.

3. The water ski of claim 1 in which said ski body is about 68 inches long and said point is about 33 inches from the tail end.

4. The water ski of claim 1 in which said point is adjacent the rear of the front foot binding.

5. The water ski of claim 1 in which said one side is farther away from said longitudinal line than said other side in the forward portion of the ski.

6. The water ski of claim 1 in which said one side is about 1/16 to ⅛ inch farther from said longitudinal line than said other side in the forward portion of the ski.

7. The water ski of claim 1 in which said one side extends generally parallel to said longitudinal line adjacent the front foot binding.

8. The water ski of claim 1 in which said bottom surface has a relatively flat portion adjacent each of said sides, said ski body having a beveled portion extending between each of said sides and the adjacent flat portion of the bottom surface, the angle between the flat portion of the bottom surface and the beveled portion at said one side being less than the angle between the flat portion of the bottom surface and the beveled portion at the other side.

9. The water ski of claim 8 in which the angle of the beveled portion at said one side is about 37° and the angle of the beveled portion at said other side is about 42°.

10. The water ski of claim 8 in which each of said beveled portions is about ⅜ to ½ inch wide.

11. A slalom water ski comprising an elongated ski body having a longitudinal centerline and front and rear foot bindings mounted on the ski body along the longitudinal centerline, the ski body having top and bottom surfaces, a forward end, a tail end, and a pair of sides extending between the forward end and the tail end, said bottom surface having a relatively flat portion adjacent each of said sides, and a beveled portion extending between each of said sides and the adjacent flat portion of the bottom surface, the angle between the flat portion of the bottom surface and the beveled portion on one side being less than the angle between the flat portion of the bottom surface and the beveled portion on the other side.

12. The water ski of claim 11 in which the angle of the beveled portion on said one side is about 37° and the angle of the beveled portion on said other side is about 42°.

13. The water ski of claim 11 in which each of said beveled portions is about ⅜ to ½ inch wide.

* * * * *